US009757946B2

(12) United States Patent
De Roeck et al.

(10) Patent No.: US 9,757,946 B2
(45) Date of Patent: Sep. 12, 2017

(54) INKJET MAINTENANCE DEVICE WITH A LIQUID SPREADING MESH

(71) Applicant: AGFA GRAPHICS NV, Mortsel (BE)

(72) Inventors: Luc De Roeck, Mortsel (BE); Paul Wouters, Mortsel (BE)

(73) Assignee: AGFA GRAPHICS NV, Mortsel (BE)

( * ) Notice: Subject to any disclaimer, the term of this patent is extended or adjusted under 35 U.S.C. 154(b) by 0 days.

(21) Appl. No.: 15/120,167

(22) PCT Filed: Feb. 27, 2015

(86) PCT No.: PCT/EP2015/054153

§ 371 (c)(1),
(2) Date: Aug. 19, 2016

(87) PCT Pub. No.: WO2015/132153

PCT Pub. Date: Sep. 11, 2015

(65) Prior Publication Data

US 2017/0057232 A1 Mar. 2, 2017

(30) Foreign Application Priority Data

Mar. 5, 2014 (EP) ..... 14157777

(51) Int. Cl.
*B41J 2/165* (2006.01)
*B41J 2/17* (2006.01)

(52) U.S. Cl.
CPC ..... *B41J 2/165* (2013.01); *B41J 2/16523* (2013.01); *B41J 2/16526* (2013.01)

(58) Field of Classification Search
CPC ..... B41J 2/165; B41J 2/16523; B41J 2/1721
See application file for complete search history.

(56) References Cited

U.S. PATENT DOCUMENTS

| | | | | |
|---|---|---|---|---|
| 6,193,353 | B1 | 2/2001 | Vives et al. | |
| 2002/0075348 | A1 | 6/2002 | Shindo et al. | |
| 2010/0118083 | A1* | 5/2010 | Kobayashi | B41J 2/185 347/31 |
| 2011/0298875 | A1 | 12/2011 | Kobashi et al. | |
| 2013/0135386 | A1 | 5/2013 | Kakigahara | |
| 2013/0241994 | A1* | 9/2013 | Katoh | B41J 2/16532 347/30 |
| 2013/0241995 | A1 | 9/2013 | Maruyama | |

FOREIGN PATENT DOCUMENTS

| | | |
|---|---|---|
| EP | 1 018 430 A1 | 7/2000 |
| EP | 1 083 052 A2 | 3/2001 |

OTHER PUBLICATIONS

Official Communication issued in International Patent Application No. PCT/EP2015/054153, mailed on May 11, 2015.

* cited by examiner

*Primary Examiner* — Jason Uhlenhake
(74) *Attorney, Agent, or Firm* — Keating and Bennett, LLP

(57) ABSTRACT

An inkjet print device includes a maintenance device wherein a mesh system and a waste liquid receiver are mounted. The liquid is applied during maintenance on the top of the mesh system and a waste liquid receiver receives the liquid dripping from the back of the mesh system. The mesh system is characterized by including a liquid spreading mesh.

14 Claims, 4 Drawing Sheets

INKJET MAINTENANCE DEVICE WITH A LIQUID SPREADING MESH

CROSS-REFERENCE TO RELATED APPLICATIONS

This application is a 371 National Stage Application of PCT/EP2015/054153, filed Feb. 27, 2015. This application claims the benefit of European Application No. 14157777.5, filed Mar. 5, 2014, which is incorporated by reference herein in its entirety.

BACKGROUND OF THE INVENTION

1. Field of the Invention

The present invention relates to an inkjet print device and more specifically the invention is related to an improved maintenance device for an inkjet print head.

2. Description of the Related Art

Nowadays inkjet print devices are used in a wide array of apparatuses in a wide array of applications such as fax, color photo printing, industrial applications etc. In these printing systems liquids, possibly of various colors, is ejected out of an array of nozzles located on the liquid ejecting surface of an inkjet print head to a receiving material, such as a substrate.

A long known problem in inkjet print devices is that the nozzles through which the liquid is projected to the receiving material are blocked by clogging of liquid inside the nozzles and on the print head. This renders certain nozzles inoperable and results in a defective print of deteriorated print quality.

To improve the clarity and contrast of the printed image, recent research has been focused to improvement of the liquids used. To provide quicker, more water fast printing with darker blacks and more vivid colors, pigment based liquids have been developed. These pigment-based liquids have a higher solid content than the earlier dye-based liquids. Both types of liquid dry quickly, which allows inkjet printing mechanisms to forms high quality images.

The combination of small nozzles and quick drying liquid leaves the print heads susceptible to clogging, not only from dried liquid and minute dust particles or paper fibers, but also from the solids within the new liquid themselves.

It is known to counteract or correct the problem of clogging by protecting and cleaning the print head by various methods such as wiping, spitting, capping or purging. Also other methods exist for cleaning an inkjet print head which may include applying solvents as in EP1018430 (HEWLETT PACKARD).

These features designed to clean and to protect an inkjet print head are commonly concentrated in a maintenance device which is mounted within the inkjet print device, and wherein the print head can be moved over the station for maintenance. An example of such a maintenance device can be found in U.S. Pat. No. 6,193,353 (HEWLETT PACKARD) combining wiping, capping, spitting and purging functions.

During a maintenance method, such as purging, relatively large quantities of liquid are released by the inkjet print head into the maintenance device. This purged liquid can remain in the maintenance device and can afterwards dry and form, over a longer period of time, large dried liquid residues, such as stalagmite forming of dried liquid in a spittoon.

Therefore usually a system for removal of the purged liquid and dried particles is provided but they are not effective and don't evacuate the received liquid easily and fast.

For the same reason liquid fog, also called aerosol of liquid, that is released during maintenance method, such as spitting, is not evacuated easily which contaminates the inkjet print device, such as the liquid ejection surface of an inkjet print head, and may give the opportunity for inhalation by the operator.

It is clear there is a need for an improved maintenance device to provide a clean system wherein the operator and structure in the inkjet print device such as inkjet print head and any type of sensors can not be contaminated by liquid spatter and liquid fog.

An example of a maintenance unit, more specific a capping unit for an inkjet print head, is disclosed in EP1083052 (SEIKO EPSON) wherein a filter, in here called as liquid absorption member, is disclosed in FIG. 30 to filter and absorb the ink after it is received in a waste liquid receiver. There is no solution in this disclosure to evacuate the liquid fast to prevent contaminating the inkjet print device or inhalation of fog by the operator.

Another example of a maintenance unit is disclosed in US2011298875 (KOBASHI MASARU) wherein a contact member is in contact with the inkjet print head and the contact member comprises flow channels which may to allow a passage through the contact member as disclosed in [0076] but is silent about the fast evacuation of the liquid to prevent contamination the inkjet print device or inhalation of fog by the operator. Also the contact of the maintenance unit with the inkjet print head is odious because it causes scratches to the liquid ejection surface which is a disadvantage of the print quality formed by the inkjet print head after maintenance.

SUMMARY OF THE INVENTION

In order to overcome the problems described above, preferred embodiments of the present invention have been realised with a maintenance device for an inkjet print device as defined below and a maintenance method for an inkjet print device as also defined below.

A preferred embodiment of the invention is an inkjet print device with a maintenance device comprising a mesh system, a waste liquid receiver and an inkjet print head operable to apply a liquid, such as an ink, on the top of the mesh system. The waste liquid receiver arranged at a position facing the inkjet print head across the mesh system to receive liquid dripping from the back of the mesh system, during maintenance, is able to evacuate the waste liquid fast and efficiently by the mesh system which comprises a liquid spreading mesh. Preferably the liquid spreading mesh is a layer at the bottom of the mesh system to evacuate the waste liquid towards the waste liquid receiver.

A mesh is in the present invention considered as any fabric, knitted or woven, with an open, fine or coarse texture. Often a mesh is used as filtering of a liquid where the liquid is passing through the openings of the mesh but some meshes have the characteristic that a liquid, even it came from one nozzle in an inkjet printhead, is first spread out/over the mesh and than via the openings dripped down. Such meshes are called in the present invention: liquid spreading meshes.

It is found that a liquid spreading mesh is very effective for fast evacuating the waste liquid. Hence the contamination of the inkjet print device and the inhalation of liquid fog by the operator of the inkjet print device is less. The liquid spreading mesh forms an ideal flow channel for the waste liquid due to:

- a relatively uniform structure, allowing the liquid to flow over the hole area without restriction to a limited number of flow channels as in the state of the art;
- the overall affinity of the mesh to the liquid in use, which is normally related to the surface tension values of the liquid versus the material of the mesh;
- the structure of the mesh which can propagate the liquid spreading by having different mesh openings.

The waste liquid immediately spread open and accumulation of dried liquid is counteracted on the liquid spreading mesh.

A preferred embodiment evacuates the waste liquid captured in the waste liquid receiver by providing a liquid outlet in the waste liquid receiver to improve the evacuation. It is found for a more preferred embodiment that selecting a liquid spreading mesh with spreading properties in the direction towards the liquid outlet, improves the evacuation of the waste liquid and for a most preferred embodiment that constructing the bottom of the waste liquid receiver sloping down in the direction of the outlet, improves the evacuation of the waste liquid.

The evacuation of the waste liquid has to be fast. The maintenance of an inkjet print head, such as in a purging method, may cause a large amount of waste liquid that have to be evacuated quickly. Hence a smaller waste liquid receiver with liquid outlet is an improvement. The evacuation of the waste liquid through the liquid outlet may be also easily evacuated by connecting a vacuum source to the liquid outlet or by constructing one or more gutters towards the outlet. The waste liquid, such as waste liquid, may also be cured or dried if no fast evacuation is foreseen.

It is found that especially metal mesh structures are suitable to be used as a liquid spreading mesh. To avoid corrosion, it is advantageous to use a stainless steel woven mesh.

A further advantage that can be obtained by using a special weave structure in the liquid spreading mesh, it is possible to obtain a liquid spreading mesh having better liquid spreading properties in one direction relatively to other directions. These anisotropic liquid spreading characteristics of a liquid spreading mesh can be obtained by choice of composition, surface coating or surface structure of the wires but preferably the use of different wire thickness and the associated weaving pattern.

To avoid splashes of waste liquid from the liquid spreading mesh after receiving the waste liquid, the mesh system comprises a liquid resistant porous substrate on top of the liquid spreading mesh. Not only for avoiding splashes of waste liquid, it is found that the liquid resistant porous substrate avoids also liquid fog wherein the capillarity of the pores is of importance. It is important that the porous substrate is liquid resistant else it looses its porosity. Preferably the liquid resistant porous substrate is supported by a rigid mesh such as the liquid spreading mesh to avoid bending of the liquid resistant porous substrate.

The splashes of waste liquid and liquid fog may be minimized when the porous substrate on top of the liquid spreading mesh has the following characteristics:

- the porous substrate is filled with more than 90% of wasted liquid of total receiving capacity of the porous substrate; and
- the receiving capacity of the top layer on the porous substrate for wasted liquid is 10% higher than the liquid dripping capacity of the bottom layer on the porous substrate for the wasted liquid through the porous substrate.

The characteristics of the porous substrate may become in time less effective thus in a preferred embodiment the porous substrate is replaceable. It is preferably held down to the liquid spreading mesh by a fixing system.

It is found that liquid fog contamination and waste liquid contamination may be minimized when the porous substrate has a higher capillary flow of liquid at the top layer on the porous substrate than at the bottom side on the porous substrate. The liquid layer thickness of waste liquid on top of the mesh system shall be very thin which gives less contamination of the inkjet print device and no inhalation of liquid fog by the operator.

Several liquid resistant porous substrates are investigated but it is found for a preferred embodiment that a porous substrate comprising liquid permeable knitted polyester results most effective. Liquid permeable knitted polyester is liquid-resistant and the porosity is caused by the open structures between the yarns of the knitted polyester.

In a preferred embodiment of the inkjet print device, the waste liquid receiver and the mesh system are attached in a capping device for capping the inkjet print head.

To avoid agglomeration of waste liquid during non-operational periods the print head can be sealed off from contaminants by a sealing enclosure contacting the liquid ejecting surface. This also prevents the drying of the liquid. The capping unit usually consists of a rubber seal placed in contact with the liquid ejecting surface around the nozzle array. In a preferred embodiment the waste liquid receiver and the mesh system are attached in the capping device for capping the inkjet print head. Preferably the capping device comprises a sealing lip for contacting the liquid ejection surface of the inkjet print head.

Another preferred embodiment of the invention is a maintenance method for an inkjet print head comprising the method steps of:

- purging or spitting liquid from the inkjet print head; and
- spreading the purged liquid through a liquid spreading system, comprised in a mesh system, to a waste liquid receiver.

DETAILED DESCRIPTION OF THE PREFERRED EMBODIMENTS

Inkjet Print Device

Figure 1:
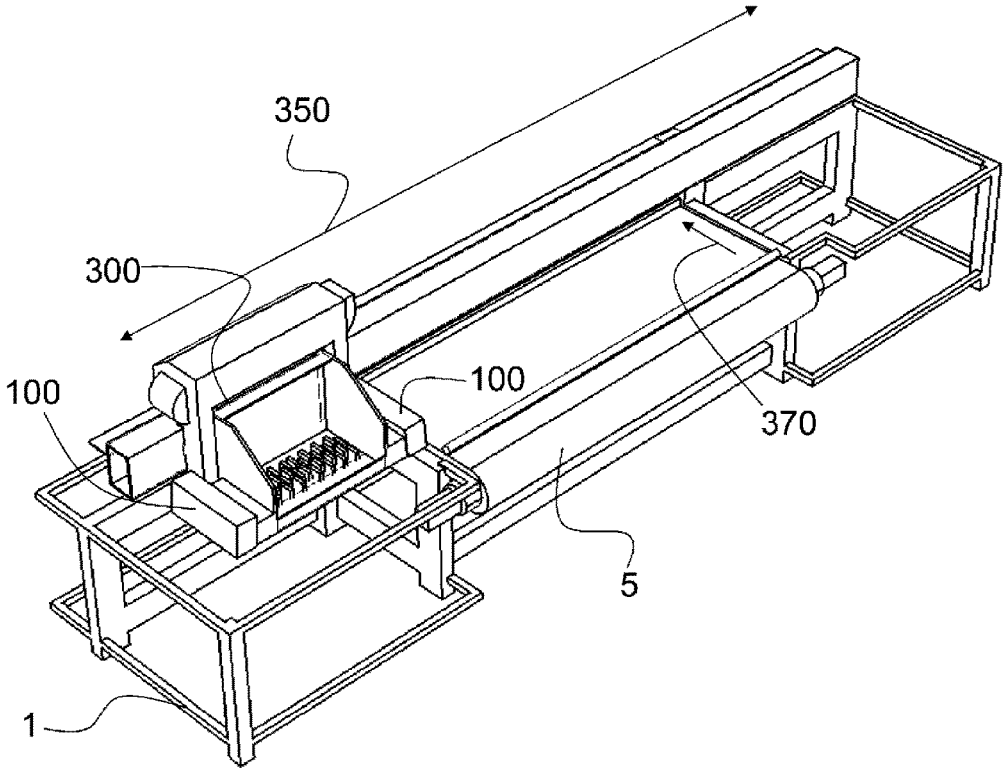
FIG. 1 illustrates a wide-format UV inkjet printer (1) as preferable embodiment of the UV inkjet printer which comprises a movable inkjet print head module (300) with a plurality of UV inkjet print heads. At both sides of the movable inkjet print head module (300) an UV radiation device is attached (100). The direction wherein the inkjet print head module is moving (forth and back) is the fast scan direction (350). The direction wherein a receiver is moving on the conveyor belt (5) underneath the inkjet print head module (300) is the slow scan direction (370). Under the current position of the movable inkjet print head module (300) a maintenance device (not visible) is attached to the wide-format UV inkjet printer (1).
Figure 2:
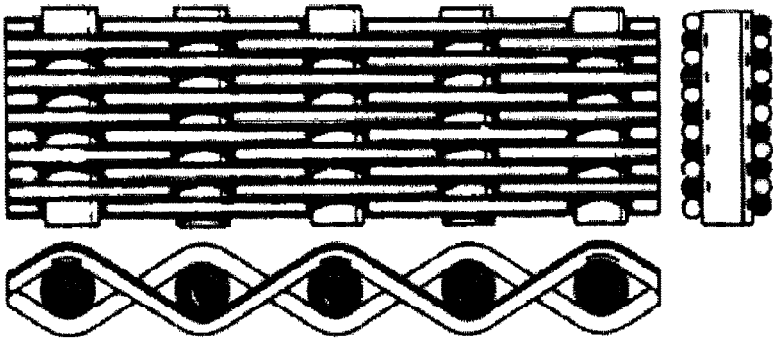
FIG. 2 gives a detailed view of a liquid spreading mesh (HIFLO) used in a preferred embodiment to the present invention.
Figure 3:
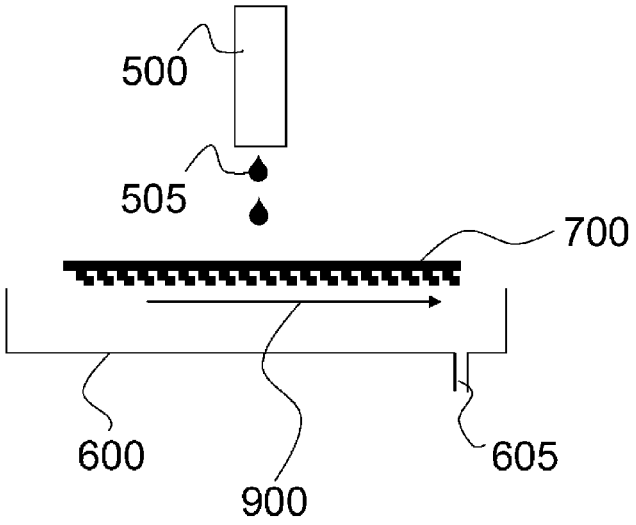
FIG. 3 illustrates an inkjet print device (not visible) with an inkjet print head (500) which purges a liquid (505) on a mesh system. The mesh system comprises a liquid spreading mesh (700) whereon the purged liquid is jetted. The waste liquid is evacuating by the liquid spreading characteristics mainly in the horizontal direction (900) towards a liquid outlet (605) provided in the waste ink receiver (600).
Figure 4:
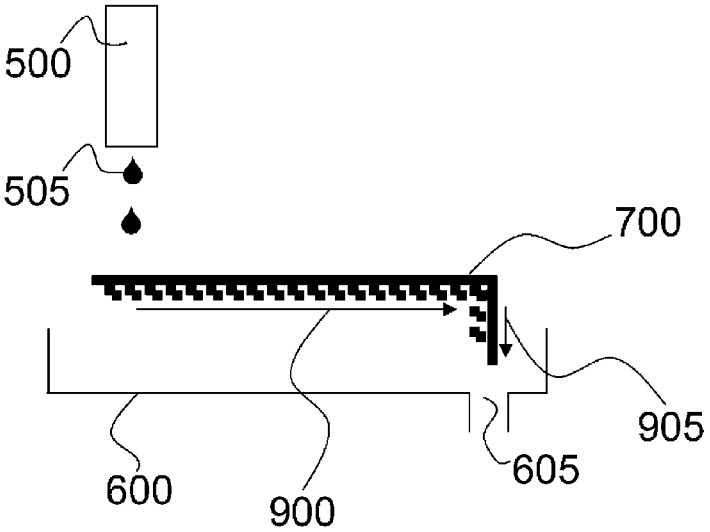
FIG. 4 illustrates an inkjet print device (not visible) with an inkjet print head (500) which purges a liquid (505) on a mesh system. The mesh system comprises a liquid spreading mesh (700) whereon the purged liquid is jetted. The waste liquid is evacuating by the liquid spreading characteristics mainly in the horizontal direction (900) and the vertical direction (905) towards a liquid outlet (605) provided in the waste ink receiver (600).
Figure 5:
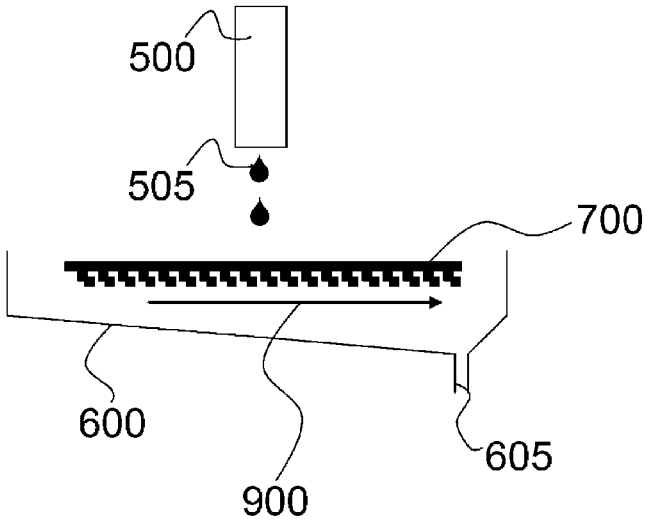
FIG. 5 illustrates an inkjet print device (not visible) with an inkjet print head (500) which purges a liquid (505) on a mesh system. The mesh system comprises a liquid spreading mesh (700) whereon the purged liquid is jetted. The waste liquid is evacuating by the liquid spreading characteristics mainly in the horizontal direction (900) towards a liquid outlet (605) provided in the waste ink receiver (600). To evacuate faster the waste liquid the bottom of the waste ink receiver (600) is sloping down towards the liquid outlet (605).
Figure 6:
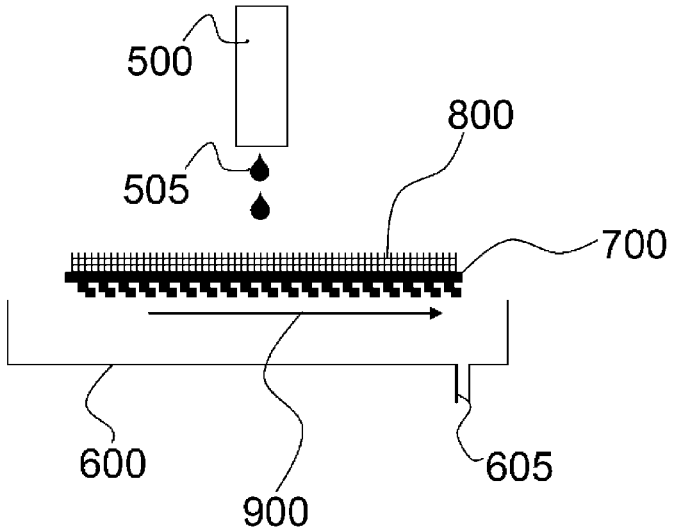
FIG. 6 illustrates an inkjet print device (not visible) with an inkjet print head (500) which purges a liquid (505) on a mesh system. The mesh system comprises a liquid spreading mesh (700) whereon the purged liquid is jetted. The waste liquid is evacuating by the liquid spreading characteristics mainly in the horizontal direction (900) towards a liquid outlet (605) provided in the waste ink receiver (600). The mesh system comprises on top of the liquid spreading mesh (700) a porous substrate (800) which is supported by the liquid spreading mesh (700).
Figure 7:
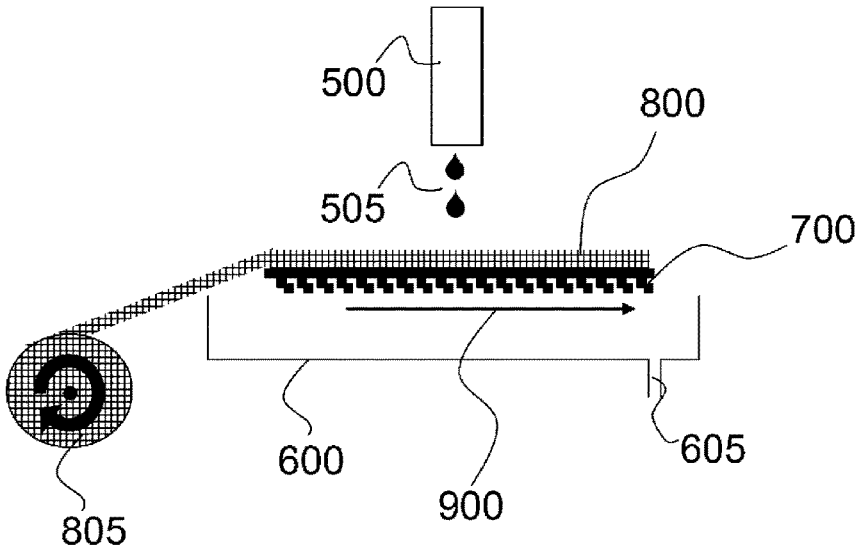
FIG. 7 illustrates an inkjet print device (not visible) with an inkjet print head (500) which purges a liquid (505) on a mesh system. The mesh system comprises a liquid spreading mesh (700) whereon the purged liquid is jetted. The waste liquid is evacuating by the liquid spreading characteristics mainly in the horizontal direction (900) towards a liquid outlet (605) provided in the waste ink receiver (600). The mesh system comprises on top of the liquid spreading mesh (700) a porous substrate (800) which is supported by the liquid spreading mesh (700). The porous substrate is provided on the liquid spreading mesh (700) by a roll (805) of porous substrate (800).
Figure 8:
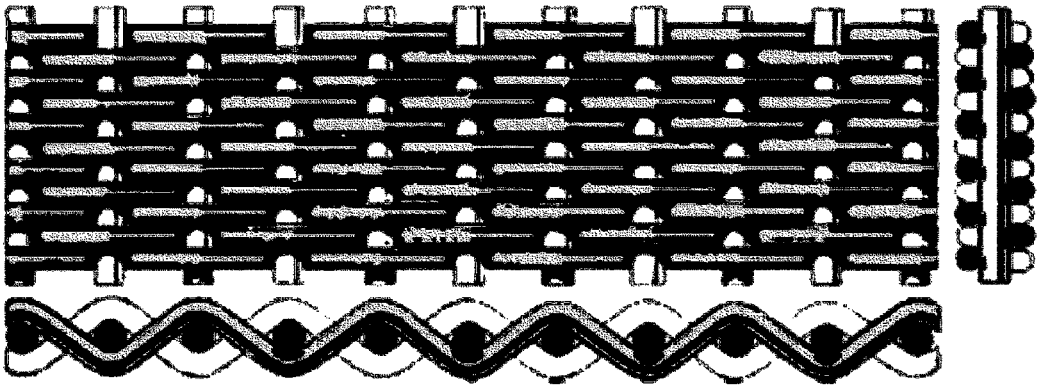
FIG. 8 and FIG. 9 give a detailed view of liquid spreading meshes (SPW) used in a preferred embodiment to the present invention.
Figure 9:
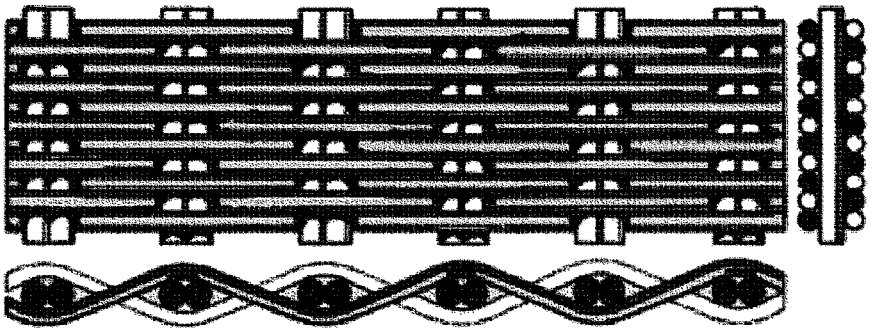

An inkjet print device comprises an inkjet print head to print a liquid, such as an ink, on the substrate. There are several types of inkjet print heads. The inkjet print device of the preferred embodiment may comprise inkjet print head capable of using continuous inkjet, piezo DOD inkjet, thermal inkjet, hertz continuous mist inkjet, electrostatic drop-on-demand (EIJ), inkjet fault tolerant printing (LIFT), magnetic inkjet (MIJ) or acousting inkjet printing (AIP) technology.

A preferred print head for the inkjet print device in the preferred embodiment is a so-called valve jet print head. Preferred valve jet print heads have a nozzle diameter between 45 and 600 μm. This allows for a resolution of 15 to 150 dpi which is preferred for having high productivity while not comprising quality.

In a preferred embodiment, the resolution of the valve jet print head is 15 to 150 dpi, preferably the resolution is no more than 75 dpi, more preferably no more than 50 dpi for maximizing printing speed and productivity. The valve jet print head preferably jets droplets of 1 to 1500 nanoliter, which is much more than the picoliter droplets used jetted most piezoelectric or thermal inkjet printing systems.

The way to incorporate valve jet print heads into the print equipment is well-known to the skilled person. For example, US2012105522 (MATTHEWS RESOURCES INC) discloses a valve jet printer including a solenoid coil and a plunger rod having a magnetically susceptible shank.

Suitable commercial valve jet print heads are chromo-JET™ 200, 400 and 800 from Zimmer and Printos™ P16 from VideoJet.

Another preferred inkjet print head is a through flow inkjet print head wherein the particles, such as pigments, in the liquid permit free flow of the liquid through the inkjet print device, especially at the ejecting nozzles to prevent sedimentation of pigment particles in the inkjet print head. The advantageous effects of liquid circulation are:

Auto and quick recovery of failing nozzles;
Stable print quality with uniform temperature;
Easy to fill ink;
Improve productivity;
Reduce running cost.

A suitable commercial through flow inkjet print head is CF1 from Toshiba Tec Corporation.

Preferably the inkjet print device is a multi-pass inkjet print device, such as a wide format inkjet print device and more preferably a single pass inkjet print device by e.g. a page-wide inkjet print head array wherein the substrate is passed by a inkjet print head is only once. The page-wide inkjet print head array may be constructed monolithically.

In a multi-pass inkjet print device, the inkjet print head normally scans back and forth in a transversal direction across the moving substrate. In a multi-pass printing method shingling and interlacing methods may be used as exemplified by EP 1914668 (AGFA-GEVAERT) or print masks method may be used as exemplified by U.S. Pat. No. 7,452,046 (HEWLETT-PACKARD).

Preferably the inkjet print device is a roll-to-roll device with a rotary substrate in-feed and rotary substrate out-feed and more preferably a roll-to-sheet device which comprises a rotary substrate in-feed and a substrate cutter to separate the rotary substrate in sheets.

A pattern that is printed on the surface of a substrate is preferably an image. The surface of the substrate may already be marked by a marking device, such as inkjet print device. The pattern may have an achromatic or chromatic colour. To enhance the adhesion of the pattern on the substrate the inkjet print device may comprise a drying system, such as an UV source, to dry the marked pattern on the substrate to have a better adhesion. Most preferably the inkjet print device with one or more inkjet print heads jets an UV curable liquid to mark the surface of the substrate.

Spreading of a UV curable inkjet liquid on a substrate can further be controlled by a partial curing or "pin curing" treatment wherein the liquid droplet is "pinned", i.e. immobilized and no further spreading occurs. For example, WO 2004/002746 (INCA) discloses an inkjet printing method of printing an area of a substrate in a plurality of passes using curable liquid, the method comprising depositing a first pass of liquid on the area; partially curing liquid deposited in the first pass; depositing a second pass of liquid on the area; and fully curing the liquid on the area.

A preferred configuration of UV source is a mercury vapour lamp. Within a quartz glass tube containing e.g. charged mercury, energy is added, and the mercury is vaporized and ionized. As a result of the vaporization and ionization, the high-energy free-for-all of mercury atoms, ions, and free electrons results in excited states of many of the mercury atoms and ions. As they settle back down to their ground state, radiation is emitted. By controlling the pressure that exists in the lamp, the wavelength of the radiation that is emitted can be somewhat accurately controlled, the goal being of course to ensure that much of the radiation that is emitted falls in the ultraviolet portion of the spectrum, and at wavelengths that will be effective for UV curable liquid curing. Another preferred UV source is an UV-Light Emitting Diode.

In a preferred embodiment the inkjet print device is a 3D inkjet printer that is used to create objects through a sequential layering process, also called additive manufacturing. The objects that are manufactured additively can be used anywhere throughout the product life cycle, from pre-production (i.e. rapid prototyping) to full-scale production (i.e. rapid manufacturing), in addition to tooling applications and post-production customization. The special liquids that used in such 3D inkjet printers ask for a good maintenance device.

In another preferred embodiment the inkjet print device is a CTP inkjet printer that is used to create directly a lithographic printing plate or flexographic print master. The method is also called a computer-to-plate (CTP) method. An example of a CTP inkjet printer is disclosed in EP1477308 (AGFA-GEVAERT). And another example of a CTP inkjet printer is disclosed in EP2199066 (AGFA-GRAPHICS).

In a preferred embodiment the dispended liquid, also called the jetted liquid, from an inkjet print head is an aqueous ink and in a more preferred embodiment an radiation curable inkjet ink, such as an UV curable inkjet ink. The dispended liquid may also be a solvent ink.

If the jetted liquid is a radiation curable inkjet ink: it preferably contains a dispersant, more preferably a polymeric dispersant, for dispersing the pigments. The radiation curable inkjet ink may also contain a dispersion synergist to improve the dispersion quality and stability of the ink. A mixture of dispersion synergists may be used to further improve dispersion stability.

The surface tension of the radiation curable inkjet ink is preferably from 20 to 50 mN/m at 25° C., more preferably from 22 to 30 mN/m at 25° C. It is preferably 20 mN/m or more from the viewpoint of printability by a second radiation curable inkjet ink, and it is preferably not more than 30 mN/m from the viewpoint of the wettability.

For having a good ejecting ability, the viscosity of the radiation curable inkjet ink at the jetting temperature is preferably smaller than 30 mPa·s, more preferably smaller than 15 mPa·s, and most preferably between 1 and 10 mPa·s at a shear rate of 30 $s^{-1}$ and a jetting temperature between 10 and 70° C.

The viscosity of radiation curable inkjet ink is preferably smaller than 35 mPa·s, preferably smaller than 28 mPa·s, and most preferably between 1 and 25 mPa·s at 25° C. and at a shear rate of 30 $s^{-1}$.

The radiation curable inkjet ink may further also contain at least one inhibitor for improving the thermal stability of the ink.

The radiation curable inkjet ink may further also contain at least one surfactant for obtaining good spreading characteristics on a substrate.

The radiation curable inkjet ink preferably includes 60 to 95 wt % of polymerizable compounds, more preferably 70 to 90 wt % of polymerizable compounds based upon the total weight of the radiation curable inkjet ink.

An inkjet print device may have several sensors such as substrate position sensors, edge detection sensors, height inkjet print head sensor, cockle measurement, density measurement. If a sensor in an inkjet print device is contaminated with liquid, the performance of the inkjet print device is not guaranteed which may results in dangerous situations for an operator of the inkjet print device.

More information about inkjet print devices is disclosed in STEPHEN F. POND. Inkjet technology and Product development strategies. United States of America: Torrey Pines Research, 2000. ISBN 0970086008.

Maintenance Device

There are several causes that may get dirty ejecting surfaces of the inkjet print head which affects the jetting performance. That is one of the main reasons to do maintenance of an inkjet print head. The jetting of liquid may get dirty by collecting satellites or liquid fog on the ejecting surface. Low velocity drops may move with airflows against the ejecting surface. These airflows may be generated from jetting or passing of a substrate underneath the inkjet print head. Dust, fibers and debris from the substrate whereon is jetted or dust, fibers and debris in the environment may also cause that the ejecting surface gets dirty.

Even if volatility of the liquid is low, such as UV liquid or oil liquid, operating in a clean room or cleaning the substrates before printing, maintenance of the inkjet print head is essential to maintain the performance.

Other reasons that causes performance issues of an inkjet print head are the evaporation of liquid solvent causing local viscosity increases, film forming of resins or partial curing of curable liquids, entering of air bubbles in the liquid system of the inkjet print device while changing a liquid supply or liquid or generating of air bubbles in the liquid system of the inkjet print device.

In a preferred embodiment the maintenance device is mounted in the inkjet print device; and wherein the inkjet print head can be moved until it is positioned above the mesh system.

The following list gives an overview of maintenance methods for an inkjet print head which is performed by a maintenance device:

- Wiping: Before and during printing the liquid ejecting surface of the inkjet print head is wiped clean by using an elastomeric wiper, removing liquid residue, paper dust and other impurities; or
- Spitting: by periodically firing a number of drops of liquid through each nozzle into a waste liquid receiver, commonly called a spittoon, clogs are cleared from the nozzles. This can be concentrated to nozzles which are not used for a certain time but usually all the nozzles are actuated during spitting; or
- Capping: during non-operational periods the print head can be sealed off from contaminants by a sealing enclosure contacting the liquid ejecting surface. This also prevents the drying of the liquid. The capping device usually consists of a rubber seal placed in contact with the liquid ejecting surface around the nozzle array. Capping is of importance to reduce evaporation of liquid.
- Purging: Bringing fresh liquid to the channels of the inkjet print head. Sometimes purging is done while on the outside of the nozzles a vacuum is applied, which is called vacuum assisted purging. Preferably purging helps clearing and cleaning the nozzles and removing entrapped air in the channels of the inkjet print head.

In a preferred embodiment the distance between the liquid ejection surface and the top of the mesh system is between 0.5 mm and 4 mm, to minimize the contamination by liquid splashes and liquid fog and the inhalation of liquid fog.

The distance between the liquid ejection surface and the top of the mesh system may be changed by a lift system comprised in the inkjet print device whereby the mesh system may be lifted up or down in the Z-direction, to make the manufacturing and servicing of the maintenance device easier.

Liquid Spreading Mesh

Several meshes are investigated to have a good liquid spreading characteristic: A first type with great results is supplied by Haver & Boeker, a woven metal filter cloth HIFLO 36 of 80×700 mesh with a linen weave. Mesh is a traditional unit used to measure the fineness of woven products such as fishing nets, fencing fabric, window screening, etc., equal to the number of strands per inch. For N-mesh fabric, the distance between strands is 1/N inch or 25.4/N millimeter. In this case this means that HIFLO 36 is a woven mesh having in the length direction 80 wires/inch and in the transversal direction having up to 700 mesh wires/inch, HIFLO also has a thickness of 0.21 mm. The liquid spreading with this type is successful and the guidance to an outlet in the waste liquid receiver is advantageous.

A second type with advantageous results is supplied by Haver & Boeker, a woven metal filter cloth SPW 45 of 2/50×250 mesh with a linen weave.

Another type is the woven metal filter cloth DTW 36 of Haver & Boeker, which is also a 80×700 mesh filter cloth, but having a Dutch twilled weave (DTW) structure, which provided poorer results in liquid spreading and guidance to the outlet.

The extra parameters of HIFLO 36, SWP 45 and DTW 36 are shown in Table 1 and Table 2. These extra parameters are based on approximate values. The actual permeability performance depends on the working conditions.

Column with label 5 is the equation for filter performance in the form $DP=YxV+MxV_2$ with V=airflow in cm/sec and DP=differential pressure in mbar.

Column with label 6 is the tensile strength expressed in Newton (N) of wire weave section 10 mm wide, 100 mm long. Tensile strength testing determines the mechanical properties of metallic test specimens for example elastic limit, yield point, ultimate strength and others, by using an axial loading until rupture (breaking point) is reached.

Column with label 8 is the weight expressed in kg/m2.

Micron retention defines the diameter of the largest round particle which can pas through the liquid spreading mesh.

TABLE 1

| 1 Code | 2 Mesh | 3 Micron Retention nominal µm | 4 Micron Retention absolute µm | 8 Weight kg/m$^2$ | 9 Cloth Thickness mm |
|---|---|---|---|---|---|
| HIFLO36 | 80 × 700 | | 34-36 | 0.6 | 0.21 |
| SPW45 | 2/50 × 250 | 30 | 42-48 | 1.15 | 0.31 |
| DTW36 | 80 × 700 | 25 | 34-36 | 1.2 | 0.26 |

TABLE 2

| 1 | 5 Equation Factors for Permeability Performance | | 6 Tensile Strength | | 7 Theoretical |
|---|---|---|---|---|---|
| | | | Warp | Weft | Porosity |
| Code | Y | M | N | N | % |
| HIFLO 36 | 10 | 0.0009 | 251 | 204 | 64 |
| SPW 45 | 8.88 | 0.04369 | 310 | 670 | |
| DTW 36 | 25.81 | 0.10202 | 210 | 860 | 42 |

Mesh structure of liquid spreading meshes may be obtained by laser drilling perforation of a material but in a preferred embodiment the desired properties can be more easily and cheaper obtained by the use of woven mesh, preferable of stainless steel wires.

In a preferred embodiment the liquid spreading mesh is a woven mesh.

In a more preferred embodiment the liquid spreading mesh is a metal woven mesh, such as a steel woven mesh; and in a most preferred embodiment the liquid spreading mesh is a stainless steel woven mesh. These preferred embodiments are advantageous for the durability and lifetime of the maintenance device.

The liquid spreading mesh may give support to a liquid resistant porous substrate to avoid bending of the liquid resistant porous substrate. Hence the liquid spreading mesh has to be rigid such as a liquid spreading mesh with steel woven mesh.

These woven mesh structures can differ in several ways by variation in:

- wire thickness, wherein the wire thickness can differ in different directions or even can alternate or vary in the same direction;
- wire density wherein the number of wires over a given distance may be different;
- different materials can be used for different wires in the same or crossing directions;
- the specific weaving pattern giving rise to a certain "fabric" structure of the mesh.

In a preferred embodiment the mesh structure of a metal woven mesh as liquid spreading mesh is a high flow filter weave (HIFLO) wherein the weft wires, which are very thin in relation to the warp, are laid as close as possible against each other in a linen weave.

In another preferred embodiment the mesh structure of a metal woven mesh as liquid spreading mesh is a single plain Dutch weave (SPW) wherein weft wires are plain woven to lie as close as possible against each other in a linen weave.

The mesh structure of a metal woven mesh as the liquid spreading mesh has preferably rectangular apertures to enhance the anisotropic liquid spreading characteristic.

A liquid spreading mesh, such as a metal woven mesh, may be fold to change the direction of the liquid spreading to another direction to guide the waste liquid more efficient towards the waste liquid receiver and more preferably towards an outlet of the waste liquid receiver.

The theoretical porosity of a metal woven mesh is defined as the ratio of empty space volume to the total component volume, expressed as a percentage. In a preferred embodiment the theoretical porosity of a metal woven mesh as liquid spreading mesh is larger than 40% and smaller than 80% and in a more preferred embodiment the theoretical porosity of a metal woven mesh as liquid spreading mesh is larger than 50% and smaller than 70%.

When flow takes places across a metal woven mesh, there is a pressure differential between the input and discharge sides, dependent on the metal woven mesh structure, ambient operating conditions. With solid flow data, the pressure drop coefficient ζ (zeta) is given as characteristic value for assessing permeability.

The formula of the pressure drop coefficient is as followed:

$$\xi = \frac{\Delta p}{\frac{\rho}{2} \cdot v^2}$$

with v the liquid velocity in meter per second, Δp the pressure difference in Pa and ρ=1.2041 kg/m3 (medium air).

It is found that the pressure drop coefficient is preferably lower than 300 and larger than 40 and more preferably lower than 200 and larger than 60.

More information about the wire cloth terminology can be found in ISO 9044:1999 "Industrial woven wire cloth—Technical requirements and tests".

The weft wires and the warp of a metal woven mesh, as liquid spreading mesh, may be optimized to the viscosity of the waste liquid to evacuate the waste liquid faster with its liquid spreading characteristics and/or may be optimized to have better liquid spreading properties in one direction relatively to other directions, also called the guidance of the liquid. Preferably the direction of the liquid spreading is towards the outlet of the waste liquid receiver.

In a preferred embodiment the liquid spreading mesh is pre-treated to enhance the liquid spreading characteristics by influencing the surface tension of the liquid spreading mesh. The liquid spreading mesh maybe pre-treated by corona treatment which is a surface modification technique.

Other technologies used for surface treatment may be used such as in-line atmospheric plasma, flame plasma and chemical plasma systems.

The liquid spreading mesh may be pre-treated with surfactants, such as fluorsurfactants, which aids the fast evacuation of waste liquid.

The liquid spreading mesh is preferably attached to the inner surface of the waste liquid receiver to prevent the spreading of liquid outside waste liquid receiver. The liquid spreading mesh may be hold in place by its own resilience against the walls of the waste liquid receiver. Or the liquid spreading mesh may be fastened by mounting pins in the inner surface of the waste liquid receiver through mounting holes or an aperture in the liquid spreading mesh.

The composition of the liquid spreading mesh can be adapted upon the type of liquid used. To be compliant with possible types of liquids, various types of metal alloys or plastics can be used as liquid spreading mesh.

The mesh system may comprise a plurality of liquid spreading mesh layers to evacuate for example the waste liquid faster and/or to provide a better anisotropic liquid spreading characterization to the mesh system.

Liquid Resistant Porous Substrate

In a preferred embodiment a liquid resistant porous substrate is laid down on top of a liquid spreading mesh to avoid splashes of waste liquid but more important to avoid liquid fog. Together with the liquid spreading mesh spitting a purging may be performed by the same maintenance device.

The splashes of waste liquid and liquid fog may be minimized when the porous substrate on top of the liquid spreading mesh has the following characteristics:

the porous substrate is filled with more than 95% of wasted liquid; and the receiving capacity of the top layer on the porous substrate for wasted liquid is 10% higher than the liquid dripping capacity of the bottom layer on the porous substrate for the wasted liquid through the porous substrate.

The characteristics of the liquid resistant porous substrate may become in time less effective. Therefore in a preferred embodiment the liquid resistant porous substrate is replaceable. The inkjet print device may comprise a roll-system wherein flexible liquid resistant porous substrate on a roll is moved on top of the liquid spreading mesh. The operator of the inkjet print device may roll new ("fresh") flexible liquid resistant porous substrate on top of the liquid spreading mesh if the maintenance device is not performing anymore after a while. The rolling of the liquid resistant porous substrate may be performed by an electric motor.

In a preferred embodiment the liquid resistant porous substrate is held down against the liquid spreading mesh by fixing means such as a cover plate or clamps.

In a preferred embodiment the top layer of the liquid resistant porous substrate is pre-treated to enhance the capillarity of the liquid resistant porous substrate. The liquid resistant porous substrate maybe pre-treated by corona treatment which is a surface modification technique.

Other technologies used for surface treatment may be used such as in-line atmospheric plasma, flame plasma and chemical plasma systems.

The liquid resistant porous substrate may be pre-treated with surfactants, such as fluorsurfactants, which aids the fast evacuation of waste liquid.

The liquid resistant porous substrate may comprise a plurality of liquid resistant porous substrates on top of each other to evacuate for example the waste liquid faster and minimizing liquid fog.

The liquid resistant porous substrate comprises preferably fibers and yarns. The liquid resistant porous substrate is in a preferred embodiment a woven and knitted polyester fabric. The woven and knitted polyester may be pretreated with silica particles, such as Sylysia 350 which is a synthetic amorphous silica with high porosity and high purity supplied by Fuji Silysia Chemical, to improve the capillarity.

The factors which affect the capillary flow process of the liquid resistant porous substrate are primarily fabric related and include the constituent fiber chemical nature, the fabric configuration, and the geometric properties of its porous structure namely inter-fiber and inter-yarn pores. The yarn and fabric production parameters are controlling factors of the fabric properties and the capillarity.

The liquid resistant porous substrate may comprise cotton which is known for its superior liquid transfer performance. However synthetic fibers, especially polyester, are more preferred to be comprised in the liquid resistant porous substrate. The cotton and polyester fibers have different chemical nature which has great bearing on their physical properties. Cotton is a natural seed fiber which appears as long, irregular, twisted and flattened tube. Polyester on the other hand is a synthetic fiber that is produced to any desired cross section and length. While polyester can be controlled to cover a wide range of diameter and cross sectional shape, for cotton these are a result of growing and cultivation conditions.

The yarn linear density (TEX), defined as the mass or weight per unit length of the yarn, is one of the parameters which influence the capillarity of the porous substrate.

Another parameter that influences the capillarity, liquid permeability and liquid flow is the twist. Twist is usually introduced to staple spun yarns to add strength and other favorable qualities to the yarn. It is usually expressed as the number of turns per unit length. The ideal twist varies with yarn thickness: the thinner the yarn the greater is the amount of twist that has to be inserted to give the same effect. Yarn twist will vary the inter-fiber pores due to the compression levels it induces on the fibers within the yarn. Higher twist levels in the yarn makes the fibers within more compact and thus produces a harder yarn of smaller diameter.

Blending is a yarn production process through which fibers with different characteristics can be mixed to produce yarn qualities that cannot be obtained by using one type of fiber alone. The general principle of blending involves mixing of fibers as intimately as possible to form a homogeneous blend. The fiber blend ratio influences also the capillarity, liquid permeability and liquid flow is the twist.

In a preferred embodiment the yarn linear density, the twist and the fiber blend ratio are optimized to change the capillarity and the liquid flow through the liquid permeable porous substrate more effectively.

Several liquid resistant porous substrates are investigated but it is found for a preferred embodiment that a porous substrate comprising liquid permeable knitted polyester results most effective, such as plain knitted polyester fabrics. Liquid permeable knitted polyester is liquid-resistant and the porosity is caused by the open structures between the yarns of the knitted polyester.

The weight of the liquid permeable knitted polyester is preferably smaller than 300 $g/m^2$, to avoid complicated constructions to support the permeable knitted polyester due to the weight.

The following commercial liquid permeable knitted polyesters had the best results:

- 3P TruColor Flag without paper backing from Quality Media and Laminating Solutions (www.qmls.com); and
- G-Flag 117 FR without paper backing from A. Berger Textilwarenfabrik (www.bergertextil.com)

Waste Liquid Receiver

The waste liquid receiver is where, after passing the mesh system, the waste ink by a maintenance method such as purging or spitting, shall be received.

In a preferred embodiment the bottom inside the waste liquid receiver is made of a liquid repellent material.

The bottom of the waste liquid receiver may slope down in the direction of a liquid outlet to evacuate the waste liquid. At the liquid outlet a manual valve may be attached to empty the waste liquid receiver or may be attached to a permanent hose connection to evacuate the waste liquid from the waste liquid receiver to a waste jerrycan.

The bottom of the waste liquid receiver may comprise gutters to evacuate waste liquid easier to the liquid outlet.

A waste liquid receiver may comprise a plurality of liquid outlets.

The evacuation through the liquid outlet may be done by a vacuum pressure. Preferably this vacuum evacuation is done while doing the maintenance method, such as purging or spitting.

Capping Device

In a preferred embodiment the waste liquid receiver and the mesh system are attached in a capping device for capping the inkjet print head.

It is important that the liquid ejection surface of the inkjet print head is not contaminated with liquid such as liquid fog or liquid splashes, especially when the liquid is an aqueous ink or a solvent ink. The liquid spreading mesh, which is near positioned to the liquid ejection surface, connects with the waste liquid on the liquid ejection surface and evacuates quickly the waste liquid to the waste liquid receiver. To clarify the invention the liquid ejection surface is not in contact with the liquid spreading mesh.

The capping device may comprise:

- the suction cap, as waste ink receiver, being the interior of the capping device for receiving purged ink from the inkjet print head;
- the sealing lip, for contacting the liquid ejecting surface of the inkjet print head and surrounding the nozzles in the liquid ejecting surface;
- mounting edge for mounting the capping device in a holder;
- an liquid outlet for evacuating ink from the suction cap;
- a suction cap bottom.

The liquid is often connected to a vacuum source but, as the capping is usually made of a liquid repellent material, liquid drops do not tend to be evacuated easily. Therefore a liquid spreading mesh inside the suction cap of the capping device is advantageous.

Its has been found that the distance between the suction cap bottom and the liquid spreading mesh is preferably between 0 and 1 mm, but the invention also works while using larger bottom—mesh distances.

A further improvement can be obtained by using a sloping bottom to more efficiently evacuate the purged ink to the outlet hole.

Vacuum evacuation can be done during purging or during non capping instances. When capping has merely the function to prevent drying of ink it is normally not suitable to apply a vacuum as this would stimulate evaporation of the solvent. To prevent drying one has to keep the partial pressure of the solvent inside the capping at "dew point" so a saturated vapor exists and a "moist" atmosphere is present.

Another parameter is the distance of the liquid spreading mesh to the ejection surface of the inkjet print head. This is preferable about 1 to 4 mm. The position of the ink ejection surface is normally the same at the top edge of the sealing lip. The distance of the liquid ejecting surface to the mesh may vary upon the sealing lip dimensions, but also upon the forces that are applied to ensure good capping of the inkjet print head. These forces are generated by pushing the capping to the inkjet print head, but also by applying vacuum to the inside of the capping. High forces may cause a considerable deformation of the sealing lip, thereby diminishing the distance between mesh and ink ejection surface.

To avoid excessive wear and tear of the capping and sealing lip, sealing forces should be just high enough to provide good sealing, only resulting in low deformation of the sealing lip.

In a preferred embodiment the capping device comprises mounting pins to fastening the liquid spreading mesh through mounting holes in the liquid spreading mesh. But other ways to mount the liquid spreading mesh inside the suction cap can be designed. The liquid spreading mesh can be for example fixed to the elastomeric capping by introducing it during fabrication of the capping itself. Other type of mounting devices and methods could be used, for example glue or screws.

Other Preferred Embodiment

Another invention related to the previous preferred embodiments is an inkjet print device comprising

- a maintenance device comprising a mesh system; and a waste liquid receiver; and an inkjet print head operable to apply a liquid on the top of the mesh system; and the waste liquid receiver arranged at a position facing the inkjet print head across the mesh system to receive liquid dripping from the back of the mesh system, during maintenance; characterized that the mesh system comprises a liquid permeable porous substrate. Preferably the liquid permeable porous substrate is liquid resistant.

It is found that the porous substrate is filled with more than 90% of wasted liquid; and the receiving capacity of the top layer on the porous substrate for wasted liquid is 10% higher than the liquid dripping capacity of the bottom layer on the porous substrate for the wasted liquid through the porous substrate.

The characteristics of the porous substrate may become in time less effective thus in a preferred embodiment the porous substrate is replaceable. It is preferably held down to a rigid support by a fixing system.

It is found that liquid fog contamination and waste liquid contamination may be minimized when the porous substrate has a higher capillary flow of liquid at the top layer on the porous substrate than at the bottom side on the porous substrate. The liquid layer thickness of waste liquid on top of the mesh system shall be very thin which gives less contamination of the inkjet print device and no inhalation of liquid fog by the operator.

Several liquid resistant porous substrates are investigated but it is found for a preferred embodiment that a porous substrate comprising liquid permeable knitted polyester results most effective. Liquid permeable knitted polyester is liquid-resistant and the porosity is caused by the open structures between the yarns of the knitted polyester.

| Reference signs list | |
|---|---|
| 1 | Wide-format UV inkjet printer |
| 5 | Conveyor belt |
| 100 | UV radiation device |
| 300 | Inkjet print head module |
| 350 | Fast-scan direction (forth and back) |
| 370 | Slow-scan direction |
| 500 | Inkjet print head |
| 505 | Liquid |
| 700 | Liquid spreading mesh |
| 600 | Liquid waste receiver |
| 605 | Liquid outlet |
| 900 | Evacuation direction (Horizontal) |
| 905 | Evacuation direction (Vertical) |
| 800 | Porous substrate |
| 805 | Roll of porous substrate |

The invention claimed is:

1. An inkjet print device comprising:

a maintenance device including a mesh;

a waste liquid receiver; and an inkjet print head operable to apply a liquid on a top of the mesh; wherein the waste liquid receiver faces the inkjet print head with the mesh therebetween and receives liquid dripping from a back of the mesh while the maintenance device performs maintenance;

the mesh includes a liquid spreading mesh with spreading properties in a direction towards a liquid outlet of the waste liquid receiver;

a distance between a liquid ejection surface of the inkjet print head and the top of the mesh is between 0.5 mm and 4 mm; and the liquid spreading mesh includes a woven metal filter with a linen weave or a Dutch twilled weave structure.

2. The inkjet print device according to claim 1, wherein the liquid spreading mesh includes anisotropic liquid spreading characteristics.

3. The inkjet print device according to claim 2, wherein the liquid spreading mesh is a stainless steel woven mesh.

4. The inkjet print device according to claim 2, wherein a pressure drop coefficient of the liquid spreading mesh is between 40 and 300.

5. The inkjet print device according to claim 2, wherein the mesh includes a porous substrate on top of the liquid spreading mesh;

the porous substrate is liquid resistant and is capable of being filled with more than 90% of waste liquid of a total receiving capacity of the porous substrate; and a receiving capacity of a top layer of the porous substrate for the waste liquid is 10% higher than a liquid dripping capacity of a bottom layer of the porous substrate for the waste liquid that drips through the porous substrate.

6. The inkjet print device according to the claim 5, wherein the porous substrate has a higher capillary flow of liquid at the top layer than at the bottom layer.

7. The inkjet print device according to claim 6, wherein the porous substrate includes liquid permeable knitted polyester.

8. The inkjet print device according to claim 7, wherein the porous substrate is pre-treated with a surfactant.

9. The inkjet print device according to claim 8, wherein the surfactant is a fluor surfactant.

10. The inkjet print device according to claim 1, wherein the liquid is selected from aqueous liquid or UV curable liquid.

11. The inkjet print device according to claim 1, wherein the waste liquid receiver and the mesh are attached to a capping device that caps the inkjet print head.

12. The inkjet print device according to claim 11, wherein the capping device includes a sealing lip that contacts the liquid ejection surface of the inkjet print head.

13. The inkjet print device according to claim 1, wherein a bottom surface of the waste liquid receiver slopes downward in the direction towards the liquid outlet.

14. A maintenance method for an inkjet print head, the method comprising the steps of:

purging or ejecting liquid from the inkjet print head; and spreading the purged or ejecting liquid through a liquid spreading mesh to a waste liquid receiver; wherein the liquid spreading mesh includes spreading properties in a direction towards a liquid outlet of the waste liquid receiver;

a distance between a liquid ejection surface of the inkjet print head and a top of the mesh liquid spreading mesh is between 0.5 mm and 4 mm; and the liquid spreading mesh includes a woven metal filter with a linen weave or a Dutch twilled weave structure.

* * * * *